United States Patent [19]

Sakai et al.

[11] 4,011,082

[45] Mar. 8, 1977

[54] SILVER HALIDE PHOTOGRAPHIC MATERIAL

[75] Inventors: Takeo Sakai; Masakazu Yoneyama; Nobuo Yamamoto, all of Minami-ashigara, Japan

[73] Assignee: Fuji Photo Film Co., Ltd., Minami-ashigara, Japan

[22] Filed: June 6, 1975

[21] Appl. No.: 584,674

[30] Foreign Application Priority Data

June 6, 1974 Japan ..... 49-64437

[52] U.S. Cl. ..... 96/95; 96/66.3; 96/107; 96/114.5

[51] Int. Cl.[2] ..... G03C 1/06; G03C 5/30; G03C 1/28; G03C 1/38

[58] Field of Search ..... 96/107, 95, 66.3, 114.5

[56] References Cited

UNITED STATES PATENTS

| | | | |
|---|---|---|---|
| 3,895,948 | 7/1975 | Shiba et al. | 96/107 |
| 3,915,713 | 10/1975 | Shiba et al. | 96/107 |
| 3,929,486 | 12/1975 | Habu et al. | 96/107 |

*Primary Examiner*—Mary F. Kelley
*Attorney, Agent, or Firm*—Sughrue, Rothwell, Mion, Zinn & Macpeak

[57] ABSTRACT

A silver halide photographic lithographic light-sensitive material having high halftone contrast comprising a support having thereon at least one hydrophilic colloid containing layer and containing at least one compound represented by the following formulae

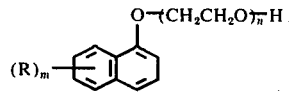

(I)

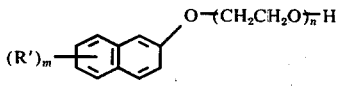

(II)

wherein R and R′ each represents a hydrogen atom or an alkyl group containing from 1 to 18 carbon atoms, *m* is an integer of 1 or 2, and *n* is an integer of from 10 to 150, and at least one anionic surface active agent having a sulfonic group.

12 Claims, No Drawings

SILVER HALIDE PHOTOGRAPHIC MATERIAL

BACKGROUND OF THE INVENTION

1. Field of the Invention

This invention relates to an improved silver halide photographic material and particularly to a silver halide photographic lithographic light-sensitive material having a high contrast halftone gradation.

2. Description of the Prior Art

In photographic printing plate formation in the printing industry, a continuous tone photographic image is converted into a halftone screened image, which is then utilized to prepare a printing plate. Ordinarily three color separated halftone positives are produced from a photographic multi-color print by first making color separation negatives therefrom, exposing a lithographic light-sensitive material which is in an intimate contact with a contact screen or cross-hatched screen to light through each of these separation negatives, and then processing the exposed lithographic light-sensitive material with a lithographic developer. Recently, direct screening methods are becoming prevalent in photo plate making whereby a color separated halftone image can be obtained by exposure through a halftone screen and a color filter. While a conventional, indirect process gives halftone positives, such a direct process provides halftone negatives.

Such a screened image (negative or positive) comprises dots with different sizes, and the image density varies depending on the ratio of the area occupied by the dots. A greater change of the total dot area ratio implies a higher contrast on a halftone gradation. One can calculate the halftone contrast from the relationship between the logarithm of the exposure and the dot area ratio or the integrated density (e.g., as disclosed in J.A.C. Yule, *Principles of Color Reproduction*, p. 90–92, John Wiley & Sons Inc. (1967)).

The halftone contrast is quite important to determine the tonal rendition of the final print. Usually the contrast of a halftone negative should be higher than that of a halftone positive and particularly the contrast at the density range higher than the 50% dot area should be sufficiently high. This requirement is due to the fact that, in printed materials, the highlight rendition in which it is somewhat difficult to faithfully reproduce the extremely small dots during the printing process, is of great value; therefore, the contrast at the highlight area, i.e., at the high density region in the halftone negative, must be emphasized.

A usual technique in the printing industry adopted to increase the contrast of a halftone image is the use of a high contrast contact screen or of an auxiliary exposure generally called a no screen or highlight exposure. The former method, however, requires that various contact screens be maintained, requiring additional expense as well as complicated management of the screens, while the latter method has the difficulty of determination of exposure conditions and also a tendency for the dot quality to deteriorate. A vigorous stirring of the developer during processing of a photographic lithographic light-sensitive material can increase the halftone contrast, which method, however, cannot be employed in development in an automated processor.

Further, the dot quality as well as the halftone contrast of the image obtained by development of a photographic lithographic light-sensitive material also determines the final quality of the printing plate. A halftone screened image must comprise dots, each without fringe therearound and with a sufficiently high contrast. To achieve this requirement, processing with a hydroquinone type, a so called lithographic developer which contains a relatively low concentration of sulfite ion is conventionally employed. It is further well known in the art that incorporation of a polyethylene oxide in the photographic material is effective to improve the dot quality for such development.

To achieve a superior dot quality is an essential requirement for photographic lithographic light-sensitive materials.

SUMMARY OF THE INVENTION

A principal object of the present invention is to provide a silver halide photographic lithographic light-sensitive material having a high halftone gradation.

Another object of the present invention is to provide a photographic lithographic light-sensitive material which can be used to form a halftone image with superior dot quality.

These and other objects are achieved with a photographic lithographic light-sensitive material comprising a support having thereon at least one hydrophilic colloid containing layer and containing at least one polyethylene oxide naphthyl ether of the general formulae

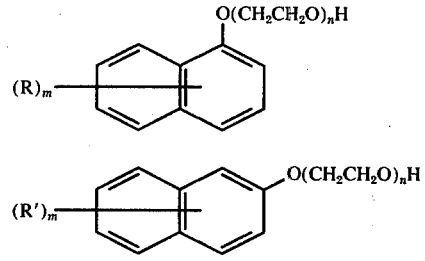

(I)

(II)

in which R and R′ each represents a hydrogen atom or an alkyl group with from 1 to 18 carbon atoms, *m* is an integer of one or two, and *n* is an integer of from 10 to 150, and at least one anionic surface active agent containing a sulfonic acid group in the molecular structure thereof.

DETAILED DESCRIPTION OF THE INVENTION

In the general formulae (I) and (II) above, the alkyl groups defined by R or R′ can be straight-chained or branched chained. More specifically, suitable specific groups are methyl, ethyl, isopropyl, 2-butyl, 2-octyl, octadecyl, etc. The position where such an alkyl group is substituted on the naphthalene ring is not limited.

Representative polyethylene oxide naphthyl ethers are given below for the purpose of illustration but the present invention should not be construed as being limited to these examples only.

| | | |
|---|---|---|
| N - 1 | Polyethylene oxide 4-tetradecyl-α-naphthyl ether | n = 50 |
| N - 2 | Polyethylene oxide α-naphthyl ether | n = 30 |
| N - 3 | | |

-continued

| | | |
|---|---|---|
| N - 4 | Polyethylene oxide α-naphthyl ether | n = 50 |
| N - 5 | Polyethylene oxide α-naphthyl ether | n = 80 |
| N - 6 | Polyethylene oxide α-naphthyl ether | n = 100 |
| N - 7 | Polyethylene oxide β-naphthyl ether | n = 10 |
| N - 8 | Polyethylene oxide β-naphthyl ether | n = 150 |
| N - 9 | Polyethylene oxide 4-nonyl-α-naphthyl ether | n = 100 |
| N - 10 | Polyethylene oxide 4-octadecyl-β-naphthyl ether | n = 50 |
| N - 11 | Polyethylene oxide 3-butyl-β-naphthyl ether | n = 80 |
| N - 12 | Polyethylene oxide 2-methyl-α-naphthyl ether | n = 150 |
| N - 13 | Polyethylene oxide 4-hexyl-α-naphthyl ether | n = 40 |
| N - 14 | Polyethylene oxide 4-dodecyl-β-naphthyl ether | n = 70 |
| | Polyethylene oxide 4-octadecyl-α-naphthyl ether | n = 110 |

The polyethylene oxide naphthyl ethers which can be used in the present invention can be synthesized by reference to *Journal of the American Oil Chemists' Society*, Vol. 48, p.107 (1971); *Chemical Abstracts*, Vol. 63, 13168d (1965); etc.

The anionic surface active agents containing a sulfonic acid group in the molecule thereof which can be used in the present invention can be selected from various compounds having an $-SO_3M$ or $-OSO_3M$ group (where M represents a hydrogen atom, an alkali metal atom, such as sodium, potassium, etc., or ammonium group, which group can be substituted with an alkyl group having 1 to 3 carbon atoms), and a hydrophobic group having 8 to 30 carbon atoms. These compounds are described in Ryohei Oda and Kazuhiro Teramura, *Kaimen-kassei-zai no Gosei to Ohyo* (*Synthesis and Applications of Surface Active Agents*), published by Maki Shoten, Japan, A. W. Schwarz and J. W. Perry, *Surface Active Agents*, Interscience Publications Inc., New York, etc.

Such anionic surface active agents are described by the following general formulae (III) and (IV)

$$R''SO_3M \quad \text{(III)}$$

$$R''OSO_3M \quad \text{(IV)}$$

wherein M is the same as defined above, and R'' is a group selecting from an alkyl group having 8 to 30 carbon atoms (e.g., decyl, dodecyl, pentadecyl, etc.), an alkylaryl group having 8 to 30 carbon atoms (e.g., dodecylphenyl, 1,4-di-t-butylphenyl, dodecylnaphthyl, etc.), an alkanoylaminoalkyl group having 8 to 30 carbon atoms (e.g., N-nonanoylaminoethyl, N-palmitoyl-N-methylaminoethyl, N-oleoyl-N-methylaminoethyl, etc.), an alkanoylaminoaryl group having 8 to 30 carbon atoms (e.g., N-decanoylaminophenyl, N-dodecanoylaminophenyl, etc.), a dialkylsuccinate group having 8 to 30 carbon atoms (e.g., di-hexylsuccinate, di-octylsuccinate, etc.), an alkylpolyoxyethylene ether group (e.g., nonyl tri-oxahexyl ether, octadecyl pentaoxadodecyl ether, etc.), an alkylphenoxypolyoxyethylene ether alkyl group (e.g., nonylphenoxy tri-oxadecyl, di-nonylphenoxy penta-oxadodecyl, etc.), an alkyl substituted heterocyclic group having 8 to 30 carbon atoms (e.g., 2-heptadecylbenzimidazolyl, etc.), an alkylaryl alkyl ether group having 8 to 30 carbon atoms (e.g., nonylphenyl propyl ether, etc.), etc. The above groups can also contain fluorine atoms as substituents replacing partially or completely the hydrogen atoms on the carbon atoms thereof.

Representative examples of anionic surface active agents having a sulfonic acid group are listed below for the purpose of illustration but the present invention is not to be construed as being limited to these examples only.

A - 1 $C_{12}H_{25}OSO_3Na$

A - 2 $C_{14}H_{29}OSO_3Na$

A - 3

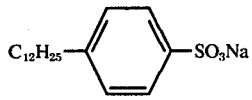

A - 4 $H(CF_2CF_2)_4CH_2O(CH_2)_3SO_3K$

A - 5

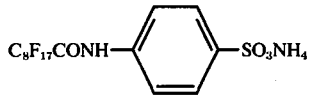

A - 6 $C_8F_{17}-CON(CH_3)CH_2CH_2SO_3Na$

A - 7 $C_8F_{17}SO_3K$

A - 8 $C_8F_{17}SO_2N(C_2H_5)CH_2CH_2SO_3Na$

A - 9 $C_8F_{17}SO_2N(C_3H_7)CH_2CH_2CH_2SO_3Na$

A - 10 $CH_2COOCH_2(CF_2CF_2)_5H$ | $CHCOOCH_2(CF_2CF_2)_5H$ | $SO_3Na$

A - 11 $C_{14}H_{29}-CH(SO_3Na)COOH$

A - 12 $CH_2COOC_6H_{13}$ | $CHCOOC_6H_{13}$ | $SO_3Na$

A - 13

-continued

A - 14

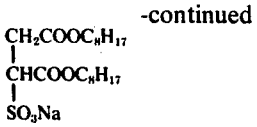

A - 15

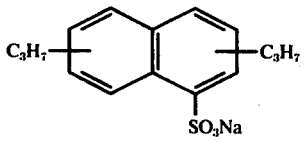

A - 16

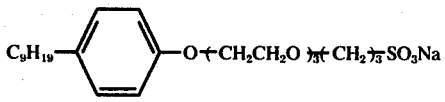

A - 17

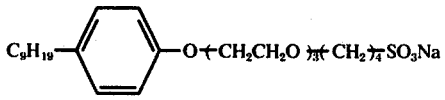

A - 18

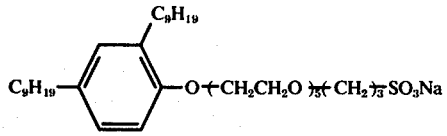

A - 19

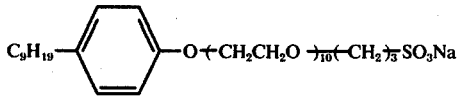

A - 20

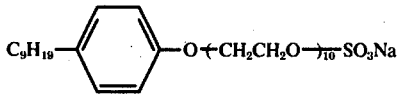

A - 21

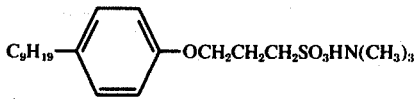

A - 22

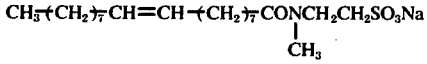

A - 23

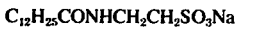

A - 24

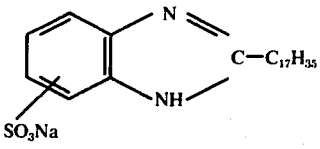

The polyethylene oxide naphthyl ether and the anionic surfactant as in the present invention can be incorporated in the same hydrophilic colloid layer or in different layers; both can be incorporated in a silver halide photographic emulsion layer or one in a silver halide emulsion layer and the other in an adjacent hydrophilic layer. The time of addition can vary, and the addition can be made at any point in the production of the silver halide photographic material. Where the compound(s) is added to the silver halide emulsion, the addition can be made following the completion of the second ripening and prior to coating of the emulsion on the support. Where the compound(s) is incorporated into a hydrophilic colloid layer, the compound(s) can be added to the coating mixture during the preparation thereof or prior to coating of the layer on the support.

The amount of the compounds can vary over a wide range depending on the type of compound used and also on the characteristics of the silver halide emulsion employed. In general, a preferred range for the polyethylene oxide naphthyl ether is from about 0.01 g to 1 g, and more preferably from 0.05 to 0.5 g, per mole of the silver halide in the emulsion, and for the anionic surfactant from about 0.1 g to 10 g, and more preferably from 0.5 to 5 g, per mole of the silver halide.

The silver halide emulsion used in the present invention is usually prepared by mixing a solution of a water-soluble silver salt (for example, silver nitrate) with a solution of a water-soluble halide (for example, potassium bromide) in the presence of a solution of a water-soluble polymeric material such as gelatin. As the silver halide, a silver chlorobromide or a silver iodochlorobromide comprising at least about 50 mole %, preferably more than about 75 mole %, silver chloride and 0 to about 5 mole % silver iodide can be employed. The crystalline structure of the silver halide can be cubic, octahedral or mixtures thereof.

As to the grain size of the silver halide, grains having an average size below about 0.7 micron, e.g., about 0.1 micron to about 0.7 micron, are preferred, although particularly fine grains are not required. The silver halide grains can be prepared using any of the conventional methods of preparation well known in the art, including the single or double jet, and control double jet methods. In addition, two or more silver halide emulsions can be prepared separately and blended afterwards if desired.

Further, each silver halide grain can have a uniform structure throughout the grain, can have a layer structure in which the outer and the inner portion are different or can be of the so-called "conversion type" as described in British Pat. No. 635,841, U.S. Pat. No. 3,622,318, etc. Each grain may be of the type providing a latent image mainly either on the surface of the grains or in the inner portion of the grains. Photographic emulsions using these grains are described in the literature including C. E. K. Mees and T. H. James, *The Theory of the Photographic Process*, 3rd Ed., MacMillan Co., New York (1966), P. Grafkides, *Chimie Photographique*, Paul Montel Co., Paris (1957), etc., and can be prepared using any of the conventionally known methods such as neutral, acid and other processes.

The silver halide particles thus prepared are washed with water to remove water-soluble by-product salts (e.g., potassium nitrate in the case of the reaction between silver nitrate and potassium bromide to form silver bromide), and then, in order to increase the light sensitivity without coarsening the grains, heat treated in the presence of a chemical sensitizer such as sodium thiosulfate, N,N,N'-trimethylthiourea, thiocyanate and a thiosulfate complex salt containing aurous ion, stannous chloride, hexamethylenetetramine, etc. Descriptions of these procedures can also be found in the above cited references.

Silver halide emulsions prepared by the above-described procedures can also be sensitized chemically in a conventional manner. Suitable chemical sensitizers include gold compounds such as chloroaurate, auric trichloride, etc., as described in U.S. Pat. Nos. 2,399,083, 2,540,085, 2,597,856, and 2,597,915; salts of noble metals such as Pt, Ir, Rh, Ru, etc., as described in U.S. Pat. Nos. 2,448,060, 2,540,086, 2,566,245, 2,566,263, and 2,598,079; sulfur compounds capable of reacting with silver compounds to produce silver sulfide as described in U.S. Pat. Nos. 1,574,944, 2,410,689, 3,189,458, 3,501,313, etc.; and stannous chloride, organic amines, and still other reducing materials set forth in U.S. Pat. Nos. 2,487,850, 2,518,698, 2,521,925, 2,521,926, 2,694,637, 2,983,610, and 3,201,254.

Hydrophilic colloids which can be used as the binder for the silver halide include gelatin, colloidal albumin, casein, cellulose derivatives such as carboxymethylcellulose, hydroxyethylcellulose, etc., polysaccharides such as agar-agar, sodium alginate, starch derivatives, etc., synthetic hydrophilic colloids such as polyvinyl alcohol, poly(N-vinylpyrolidone), polyacrylic acid copolymers, polyacrylamide, derivatives of polyacrylamide such as the partially hydrolyzed products thereof, etc. If desired, two or more of these colloids which are mutually compatible can be employed.

The most widely used hydrophilic colloid is gelatin, and the gelatin can be replaced completely or partially with other synthetic polymers or with a gelatin derivative which is obtained by treating or modifying gelatin with a compound having a group capable of reacting with the functional groups in the gelatin molecule such as amino, imino, hydroxyl, or carboxyl groups, or further with a graft polymer comprising a polymer chain grafted to gelatin through these functional groups.

The photographic emulsion and other layers can further include synthetic polymer materials; for example, a latex of a vinyl polymer which can improve the dimensional stability of the resulting photographic material, either individually or in conjunction with another polymer or with a hydrophilic water-permeable colloid. Suitable synthetic polymers include those disclosed in the following U.S. Pat. Nos. 2,376,005, 2,739,137, 2,853,457, 3,062,674, 3,411,911, 3,488,708, 3,525,620, 3,635,715, 3,607,290, and 3,645,740; and also in British Pat. Nos. 1,186,699 and 1,307,373. Suitable examples of such polymers which are generally used include homo- and copolymers comprising alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylate, alkoxyalkyl acrylates, alkoxyalkyl methacrylates, styrene, butadiene, vinyl chloride, vinylidene chloride, maleic anhydride and itaconic anhydride. A vinyl polymer of a so-called graft type, emulsion polymerized polymer latex which has been prepared through emulsion polymerization in the presence of a hydrophilic protective colloid polymer can also be used.

A variety of compounds can be added to the above-described photographic emulsion in order to prevent a reduction in sensitivity as well as a generation of fog during production, during storage or during photographic processing, including a number of heterocyclic compounds, mercury compounds, mercapto compounds and metal salts such as 4-hydroxy-6-methyl-1,3,3a,7-tetrazaindene, 3-methylbenzothiazole, 1-phenyl-5-mercaptotetrazole, etc. These compounds are described in C. E. K. Mees and T. H. James, *The Theory of the Photographic Process*, supra, p.344, and also in the following patents: U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,326,681, British Pat. Nos. 893,428, 403,789, 1,173,609 and 1,200,188.

If desired, the photographic emulsion can be sensitized spectrally or supersensitized using cyanine dyes such as the cyanines, the merocyanines, the carbocyanines, etc., individually or in combination with styryl dyes. Details of suitable spectral sensitization techniques, which are well known are set forth, for example, in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588, and 1,293,862, German Patent Applications Nos. (OLS) 2,030,326, and 2,121,780, Japanese Pat. Nos. 4936/1968, 14030/1969, and 10773/1968, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203, etc. The choice of the sensitizer depends on the purpose and end-use of the photographic material, and also on the spectral region to be sensitized.

The emulsion can be hardened in the conventional manner, suitable hardeners include aldehyde compounds such as, e.g., formaldehyde, glutaraldehyde, etc., ketones such as diacetyl and cyclopentanedione, compounds having a reactive halogen atom such as bis(2-chloroethylurea), 2-hydroxy-4,6-dichloro-1,3,5-triazine, and those set forth in U.S. Pat. Nos. 3,288,775 and 2,732,303, British Pat. Nos. 974,723, and 1,167,207, etc., those having a reactive olefin group such as divinylsulfone, 5-acetyl-1,3-diacryloylhexahydro-1,3,5-triazine, and those set forth in U.S. Pat. Nos. 3,635,718 and 3,232,763, British Pat. No. 994,869, etc., N-methylol compounds such as N-hydroxymethylphthalimide, and those disclosed in U.S. Pat. Nos. 2,732,316 and 2,586,168, etc., isocyanates such as are disclosed in U.S. Pat. No. 3,103,437, etc., aziridine compounds such as are set forth in U.S. Pat. Nos. 3,017,280 and 2,983,611, etc., acid derivatives disclosed in U.S. Pat. Nos. 2,725,294 and 2,725,295, etc., carbodiimide compounds disclosed in U.S. Pat. No. 3,100,704, etc., epoxy compounds such as are disclosed in U.S. Pat. No. 3,091,537, etc., isoxazoles such as are set forth in U.S. Pat. Nos. 3,321,313 and 3,543,292, halocarboxyaldehydes such as mucochloric acid, dioxane derivatives such as dihydroxydioxane, dichlorodioxane, etc., and inorganic hardening agents such as chrome alum, zirconium sulfate, etc.

In addition to these above-described compounds, a precursor of a hardener including an alkali metal bisulfite-aldehyde adduct, a methylol derivative of hydantoin, a primary aliphatic nitro alcohol, etc., can be used.

One or more surface active agents can be added to the above-described photographic emulsion layer and other layers. Although the surfactant is generally used as a coating aid, it sometimes is used for other purposes, e.g., as an emulsifying dispersant, an antistatic agent, an antiblocking agent, etc. Suitable surfactants include natural surface active agents such as saponin, cationic surface active agents such as higher alkyl amines, heterocyclic compounds like pyridine, phosphonium or sulfonium compounds, etc., and amphoteric surface active agents such as amino acids, amino sulfonic acids, sulfonic or phosphoric acid esters of amino alcohols, etc.

Examples of suitable surfactants which can be used in the present invention are described in U.S. Pat. Nos. 2,288,226, 2,739,891, 3,201,253, and 3,475,174, and various references such as Rhohei Oda, *KaimenKasseizai no Gosei to sono Ohyo* (*Synthesis and Applications of Surface Active Agents*, supra, A. W. Shwarz and J. W. Perry, *Surface Active Agents*, supra; J. P. Sisley, *Encyclopedia of Surface Active Agents*, Vol. 2, Chemical Publishing Co., (1964), etc. Further, quaternary ammonium salts which are set forth in German Pat. No. 1,141,531, and British Pat. No. 1,098,748, and 3-pyrazolidone compounds set forth in U.S. Pat. No. 3,518,085 so as to improve dot quality, accelerate development, increase dot contrast, and to improve development latitude can be added to the silver halide photographic emulsion layer.

To practice the present invention, those techniques disclosed in U.S. Pat. Nos. 3,600,174, 3,615,524, 3,625,689, etc., can also be employed.

The photographic emulsion can be coated on a flexible support exhibiting little dimensional change during processing. Representative flexible supports include films of cellulose nitrate, cellulose acetate, cellulose acetate butyrate, cellulose acetate propionate, polystyrene, polyethylene terephthalate and polycarbonate. Further laminates of the above-described materials can be employed. When the adhesion between the support and the photographic emulsion layer is insufficient, a subbing layer which is adhesive to both the support and the emulsion layer is usually provided therebetween. To further improve the adhesive strength, the support surface can be subjected to preliminary treatment such as a corona discharge, an ultraviolet light irradiation or flame treatment.

The lightographic developers which can be used to process the photographic materials of the present invention include a main developing agent, a sulfite ion buffer and an alkaline material.

The main developing agent can be selected from dihydroxybenzene compounds, preferably 1,2- or 1,4-dihydroxybenzene compounds, well known in the field of photography. Specific examples of dihydroxybenzene compounds are hydroquinone, chlorohydroquinone, bromohydroquinone, isopropylhydroquinone, tolylhydroquinone, methylhydroquinone, 2,3-dichlorohydroquinone, 2,5-dimethylhydroquinone, etc., with hydroquinone being particularly preferred. These compounds can be used individually or in combination. The main reducing agent is generally used in an amount of about 1 to 100 g, and more preferably 5 to 80 g per liter of the developer. The sulfite ion buffer is used in an amount effective to keep the sulfite salt concentration constant during development, and suitable compounds include aldehyde-alkali metal bisulfite adducts such as formaldehyde-sodium bisulfite adduct, ketone-alkali metal bisulfite adducts such as acetone-sodium bisulfite adduct, carbonyl bisulfite-amine condensation products such as sodium bis(2-hydroxyethyl-)aminomethane sulfonate, etc. The usual amount of the sulfite ion buffer employed ranges from about 13 to 130 g per liter of the developer.

An alkaline material is added to make the developer alkaline, and a suitable pH is preferably a pH of 9 or higher (particularly a pH of 9.7 to 11.5). A broad range of alkaline materials can be employed.

Suitable examples of alkaline materials which can be used include sodium hydroxide, potassium hydroxide, potassium carbonate, sodium carbonate, triethanol amine, diethanol amine, etc.

The concentration of the dissociated sulfite ion of the developer for the present invention can be controlled by adding an alkali metal sulfite such as sodium sulfite. The preferred amount of such an alkali metal sulfite is below about 5 g, and more preferably 3 g or less, per liter of the developer. The sulfite salt can be added in an amount above 5 g in some cases.

The developer used in the present invention can further include, in addition to the above described ingredients, a pH buffering agent such as a water-soluble acid (e.g., acetic or boric acid), a water-soluble alkali (e.g., sodium hydroxide or the other alkalis described above), or a salt (e.g., sodium carbonate), or a development controlling agent such as an alkali metal halide (e.g., potassium bromide, potassium iodide, etc.). Certain alkaline compounds not only render the developer alkaline, but also act as a pH buffer and a development controlling agent. Still other ingredients which can be added to the developer are a stabilizing agent such as ascorbic acid and kojic acid, an anti-foggant such as benzotriazole, and 1-phenyl-5-mercaptotetrazole, etc.

The developer includes all of those essential ingredients when it is used, thus it may be stored in the form of two or more separate portions. For example, two solutions can be prepared, one containing the principal reducing agent, and the other the alkaline material, and these solutions mixed together for immediate use.

Descriptions of developer compositions and development methods are given in addition to the above cited patents, in U.S. Pat. Nos. 3,925,779, 3,079,024, 3,122,086, 3,149,551, 3,156,173, 3,224,356, 3,573,914, etc.

Lithographic photographic materials are usually developed with a developer containing a small amount of sulfite ion in order to improve the dot quality. It is further well known that the presence of a polyoxyethylene oxide compound in such a developer can further improve the dot quality. Polyoxyethylene oxide derivatives which are well known in the art include polyoxyethylene oxides, condensation products of a polyoxyethylene oxide with an aliphatic alcohol, a glycol, an aliphatic acid, an aliphatic amine, a phenolic compound, or with a dehydrated cyclic derivative of hexitol. These and other compounds are disclosed in U.S. Pat. Nos. 3,288,612, 3,345,175, 3,294,540, 3,516,830, etc. Some specific examples of these compounds are listed below.

P - 1

$$HOCH_2CH_2O(CH_2CH_2O)_{50}CH_2CH_2OH$$

P - 2

$$HOCH_2CH_2O(CH_2CH_2O)_{100}CH_2CH_2OH$$

P - 3

$$(CH_2)_{10}\begin{cases} O(CH_2CH_2O)_{10}CH_2CH_2OH \\ O(CH_2CH_2O)_{10}CH_2CH_2OH \end{cases}$$

P - 4

$$HOCH_2CH_2O(CH_2CH_2O)_{25}C_{17}H_{35}$$

P - 5

-continued

P - 6

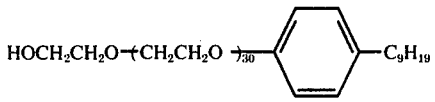

P - 7

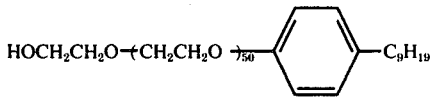

P - 8

$HOCH_2CH_2-(OCH_2CH_2)_{50}-NHC_{12}H_{25}$

P - 9

$HOCH_2CH_2O-(CH_2CH_2O)_{40}-CO-(CH_2)_7CH=CHC_8H_{17}$

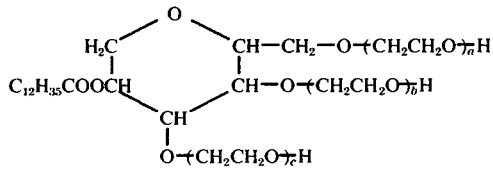

a + b + c = 60

The polyethylene oxide naphthyl ether of the present invention is effective, when added to a hydrophilic colloid layer of the photographic material, to improve the dot quality obtained by a lithographic developer just as a conventional polyethylene oxide compound described above. Moreover, such a naphthyl ether exhibits additionally the effect of increasing the halftone contrast of the dot image when such is used together with an anionic surfactant having a sulfonic acid group in the molecule, in contrast to conventional polyethylene oxide compounds which do not exhibit such a superior effect when used in combination with an anionic surfactant having a sulfonic acid group in the molecule. Considering the similarity in the chemical structure, such a distinct difference between conventional polyethylene oxides and the polyethylene oxide naphthyl ethers of the present invention is quite unexpected. U.S. Pat. No. 2,400,532 describes the effect of the combination of the above compound P - 9, i.e., polyethylene oxide ether of the dehydrated, closed ring derivative of hexitol, with an alkylnaphthalene sulfonic acid. However, the effect achieved by this technique is an improvement in photographic speed and contrast. It should be noted that the increase in contrast of a photographic emulsion or of a photographic material comprising such an emulsion layer implies a greater change of optical density (the degree of blackness of an image) with a certain amount of increase in exposure and that it is quite different from the gradation characteristic in a halftone dot image which has been explained previously herein. The combinations disclosed in U.S. Pat. No. 2,400,532 do not give rise to the advantageous effects of the present invention.

The lithographic photographic material in accordance with the present invention, includes in the hydrophilic colloid layers at least one compound represented by the general formula (I) or (II) and also at least one anionic surfactant having a sulfonic acid group in the molecular structure gives rise to a halftone dot image with superior dot quality as well as a high halftone contrast when processed with a so-called lithographic developer. These properties are significant and excellent as a lithographic light-sensitive material, particularly for use in tri-color separation negative lithographic use.

The present invention will be further explained by reference to an example of the synthesis of the polyethylene oxide naphthyl ether compound and examples of the photographic lithographic light-sensitive material of the invention. Unless otherwise indicated herein, all parts, percents, ratios and the like are by weight.

SYNTHESIS EXAMPLE

Synthesis of Compound N-1(polyethylene oxide 4-tetradecyl-α-naphthyl ether)

In a one liter three-neck flask provided with agitating means were charged and stirred 216 g (1.5 mole) of α-naphthol and 171 g (1.26 mole) of zinc chloride, 278 g (1.26 mole) of tetradecyl alcohol was added dropwise to the flask kept at 160° C. Stirring was continued for 8 hours after the completion of the addition at the same temperature. The reaction product was cooled to room temperature (i.e., 20°–30° C), and then washed with water after the addition of 500 ml of petroleum ether and 500 ml of water with stirring. This washing operation was repeated twice. The petroleum ether layer was separated, which was distilled under a reduced pressure after being dried with anhydrous sodium sulfate. 183 g of 4-tetradecyl-α-naphthol (yield: 42.7%) having boiling range of 188° to 194° C at 0.15 mmHg was obtained.

In a 2 liter three-neck flask provided with a gas inlet tube, an outlet tube with a cooler, a thermometer and an agitator 170 g (0.5 mole) of 4-tetradecyl-α-naphthol was stirred together with 1.15 g (0.05 mole) of metallic sodium as a catalyst in an nitrogen atmosphere at about 100° C until the metallic sodium disappeared. Then a successive addition reaction was carried out by gradually bubbling dry ethylene oxide gas through the gas inlet tube at an elevated temperature of 150° C. The reaction was allowed to proceed until the weight increase of the reaction system indicated the desired number of moles of ethylene oxide had been added.

EXAMPLES

A silver chloroiodobromide-gelatin emulsion which contained 80 mole % silver chloride, 19.5 mole % silver bromide and 0.5 mole % silver iodide was prepared and was chemically ripened. The average grain size of this silver halide was 0.35 micron. The amount of silver in 1 Kg of this emulsion was about 1.6 mole. Twenty five emulsion samples were prepared, each containing 62.5 g of this silver halide emulsion and a polyethylene oxide compound and/or a surface active agent having a sulfonic acid group in the molecule, as set forth in the table below. With further addition of a suitable amount of 3-carboxymethyl-5-[2-(3-ethyl-thiazolinylidene)ethylidene]rhodanine, 4-hydroxy-1,3,3a,7-tetrazaindene and mucochloric acid, each emulsion was coated on a polyethylene terephthalate film support.

| Sample No. | Polyethylene Oxide Compound | Amount Added | Sulfonic Acid Group Containing Surfactant | Amount Added |
|---|---|---|---|---|
| 1 | P - 2 | 0.15 | — | 0 |
| 2 | P - 6 | 0.08 | — | 0 |
| 3 | P - 9 | 0.15 | — | 0 |
| 4 | N - 1 | 0.15 | — | 0 |
| 5 | N - 3 | 0.08 | — | 0 |
| 6 | N - 8 | 0.10 | — | 0 |
| 7 | N - 10 | 0.10 | — | 0 |
| 8 | P - 2 | 0.15 | A - 3 | 1.0 |
| 9 | P - 2 | 0.15 | A - 16 | 1.0 |
| 10 | P - 6 | 0.08 | A - 1 | 1.0 |
| 11 | P - 6 | 0.08 | A - 3 | 1.0 |

-continued

| Sample No. | Polyethylene Oxide Compound | Amount Added | Sulfonic Acid Group Containing Surfactant | Amount Added |
|---|---|---|---|---|
| 12 | P - 6 | 0.08 | A - 14 | 1.0 |
| 13 | P - 6 | 0.08 | A - 16 | 1.0 |
| 14 | P - 9 | 0.15 | A - 3 | 1.0 |
| 15 | P - 9 | 0.15 | A - 16 | 1.0 |
| 16 | N - 1 | 0.15 | A - 3 | 1.0 |
| 17 | N - 1 | 0.15 | A - 16 | 1.0 |
| 18 | N - 3 | 0.08 | A - 1 | 1.0 |
| 19 | N - 3 | 0.08 | A - 3 | 1.0 |
| 20 | N - 3 | 0.08 | A - 14 | 1.0 |
| 21 | N - 3 | 0.08 | A - 16 | 1.0 |
| 22 | N - 8 | 0.10 | A - 3 | 1.0 |
| 23 | N - 8 | 0.10 | A - 16 | 1.0 |
| 24 | N - 10 | 0.10 | A - 3 | 1.0 |
| 25 | N - 10 | 0.10 | A - 16 | 1.0 |

The halftone contrast of these 25 samples was compared using the following method. A commercially available grey contact screen for negative use (100 lines/inch) was brought into contact with the sample, and the sample was exposed through the screen and through a step wedge with a density difference of 0.1 to white light from an incandescent lamp for 10 seconds. The exposed sample film was processed with a lithographic developer of the following composition for 3 minutes at 20° C, followed by fixing, washing and drying in a conventional manner.

| Developer Composition | |
|---|---|
| Sodium Carbonate (monohydrate) | 50 g |
| Formaldehyde-Bisulfite Adduct | 45 g |
| Potassium Bromide | 2 g |
| Hydroquinone | 18 g |
| Sodium Sulfite | 2 g |
| Water to make | 1 liter |

The halftone dot strip thus obtained was subjected to measurement of transmission density using a P-type densitometer manufactured by the Fuji Photo Film Co., Ltd., using a visual specular light flux with an aperture of 3 mm diameter to obtain a halftone transmission density — log exposure curve.

The halftone contrast index was defined by the difference on the log E axis between the point where the density was 1.3 above fog (corresponding to a 95% dot area) and the point where the density was 0.3 above fog (corresponding to a 50% dot area) on the resulting curve. From this definition it is evident that the halftone contrast is higher the smaller is value of the present halftone contrast index.

The results obtained are shown below together with the relative photographic speed data which were calculated from the point where the density was equal to 0.5 on the characteristic curve obtained by a similar exposure and processing but without using any contact halftone screen, and with dot quality evaluations by microscopic inspection of the 50% dot area using the following classifications, A: Excellent; B: Practically permissible; C: Inferior; and D: Quite poor.

| Sample No. | | Halftone Contrast Index | Relative Speed | Dot Quality |
|---|---|---|---|---|
| Containing Only a Polyethylene Oxide Compound* | | | | |
| | 1 | 0.90 | 72 | B |
| | 2 | 0.95 | 85 | A |
| | 3 | 1.03 | 93 | B |

-continued

| Sample No. | | Halftone Contrast Index | Relative Speed | Dot Quality |
|---|---|---|---|---|
| Containing Only a Polyethylene Oxide Naphthyl Ether* | | | | |
| | 4 | 0.94 | 100 | B |
| | 5 | 0.86 | 88 | A |
| | 6 | 0.91 | 95 | A |
| | 7 | 0.88 | 92 | A |
| Containing Both a Polyethylene Oxide Compound and an Anionic Surfactant* | | | | |
| | 8 | 0.93 | 72 | B |
| | 9 | 0.94 | 70 | B |
| | 10 | 0.96 | 91 | B |
| | 11 | 0.95 | 88 | A |
| | 12 | 0.98 | 82 | A |
| | 13 | 0.97 | 76 | A |
| | 14 | 1.03 | 97 | B |
| | 15 | 1.06 | 87 | B |
| Containing Both a Polyethylene Oxide Naphthyl Ether and an Anionic Surfactant** | | | | |
| | 16 | 0.83 | 105 | B |
| | 17 | 0.85 | 91 | B |
| | 18 | 0.81 | 93 | A |
| | 19 | 0.76 | 92 | A |
| | 20 | 0.79 | 87 | A |
| | 21 | 0.78 | 82 | A |
| | 22 | 0.78 | 99 | A |
| | 23 | 0.81 | 89 | A |
| | 24 | 0.80 | 95 | A |
| | 25 | 0.80 | 88 | A |

*Outside the scope of the present invention
**Within the scope of the present invention Comparisons between samples containing a polyethylene oxide compound only and those containing the same compound in conjunction with a sulfonic acid group containing anionic surfactant (i.e., comparison of Sample No. 1 with 8 and 9, No. 2 with 10 to 13, and No. 3 with 14 and 15) show that the combined use of an anionic surfactant has little effect on the halftone contrast with a slight tendency toward reducing the contrast. On the other hand, when a polyethylene oxide naphthyl ether is used in combination with an anionic surfactant according to the present invention, the halftone contrast index decreased, showing the contrast increasing effect of the present invention (as is shown in a comparison of No. 4 with 16 and 17, No. 5 with 18 to 21, No. 6 with 22 and 23, and No. 7 with 24 and 25).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one hydrophilic colloid containing silver halide emulsion and including at least one polyethylene oxide naphthyl ether represented by the following general formulae (I) and (II)

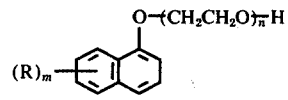

(I)

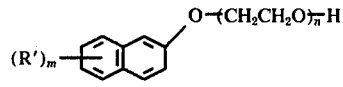

(II)

wherein R and R′ each represents a hydrogen atom or an alkyl group containing 1 to 18 carbon atoms, *m* is an integer of 1 or 2, and *n* is an integer of from 10 to 150, and at least one anionic surface active agent, wherein said anionic surface active agent is a compound containing a hydrophobic group having 8 to 30 carbon atoms and a sulfonic acid group of the formula $—SO_3M$ or $—OSO_3M$, wherein M represents a hydrogen atom, an alkali metal atom or an ammonium group.

2. The silver halide photographic material of claim 1, wherein said polyethylene oxide naphthyl ether and said anionic surface active agent are both present in said hydrophilic colloid-containing silver halide emulsion layer.

3. The silver halide photographic material of claim 1 wherein at least one additional hydrophilic colloid-containing layer is present and said polyethylene oxide naphthyl ether and said anionic surface active agent are present in different hydrophilic colloid-containing layers.

4. The silver halide photographic material of claim 1, wherein said alkyl group is a methyl group, an ethyl group, an isopropyl group, a 2-butyl group, a 2-octyl group, or an octadecyl group.

5. The silver halide photographic material of claim 1, wherein said polyethylene oxide naphthyl ether is polyethylene oxide 4-tetradecyl-α-naphthyl ether, polyethylene oxide α-naphthyl ether, polyethylene oxide 4-nonyl-α-naphthyl ether, polyethylene oxide 4-octadecyl-α-naphthyl ether, polyethylene oxide 3-butyl-α-naphthyl ether, polyethylene oxide 2-methyl-α-naphthyl ether, polyethylene oxide 4-hexyl-α-naphthyl ether, or polyethylene oxide 4-dodecyl-α-naphthyl ether.

6. The silver halide photographic material of claim 1, wherein said polyethylene oxide naphthyl ether is present in an amount of about 0.01 g to 1 g per mole of silver halide and said anionic surface active agent is present in an amount of about 0.1 g to 10 g per mole of silver halide.

7. The silver halide photographic material of claim 1 wherein at least one additional hydrophilic colloid-containing layer is present and said polyethylene oxide naphthyl ether and said anionic surface active agent are both in the same hydrophilic colloid-containing layer.

8. The silver halide photographic material of claim 1 wherein at least one additional hydrophilic colloid-containing layer is present on said hydrophilic colloid-containing silver halide emulsion layer.

9. The silver halide photographic material of claim 8, wherein one of said polyethylene oxide naphthyl ether and said anionic surface active agent is present in said silver halide emulsion layer and the other of said polyethylene oxide naphthyl ether and said anionic surface active agent is present in said hydrophilic colloid layer.

10. The silver halide photographic material of claim 8, wherein said silver halide comprises silver chlorobromide or silver iodochlorobromide, said silver chlorobromide comprising at least about 50 mole % silver chloride and said silver iodochlorobromide comprising at least about 50 mole % of silver chloride and up to about 5 mole % silver iodide.

11. A process for producing a halftone image, which comprises imagewise exposing a silver halide photographic material as claimed in claim 1, which is in intimate contact with a contact screen or a cross-hatched screen to light, and processing the material with a lithographic developer.

12. The silver halide photographic material of claim 1, wherein said anionic surface active agent is a compound represented by the following general formulae (III) and (IV)

$$R''SO_3M \quad \text{(III)}$$

$$R''OSO_3M \quad \text{(IV)}$$

wherein M represents a hydrogen atom, an alkali metal atom, or an ammonium group which may be substituted with an alkyl group having 1 to 3 carbon atoms, R″ represents an alkyl group, an alkylaryl group, an alkanoyl amino alkyl group, an alkanoylaminoaryl group, a dialkylsuccinate group, an alkylpolyoxyethylene ether group, an alkylphenoxypolyoxyethylene ether alkyl group, an alkyl substituted heterocyclic group, an alkylaryl group or an alkylarylalkyl ether group and wherein any of the hydrogen atoms on the carbon atoms of said R″ substituents may be replaced by fluorine atoms.

* * * * *